US005957779A

United States Patent [19]

Larson

[11] Patent Number: 5,957,779

[45] **Date of Patent: *Sep. 28, 1999**

[54] TOWER

[76] Inventor: Walter F. Larson, 1401 Borger, Plainview, Tex. 79072

[ * ] Notice: This patent is subject to a terminal disclaimer.

[21] Appl. No.: 08/968,256

[22] Filed: Nov. 12, 1997

Related U.S. Application Data

[63] Continuation-in-part of application No. 08/726,839, Oct. 8, 1996.

[51] Int. Cl.[6] ..... A63G 1/44

[52] U.S. Cl. ..... 472/34; 472/131

[58] Field of Search ..... 472/29, 32, 33, 472/34, 35

[56] References Cited

U.S. PATENT DOCUMENTS

| | | | |
|---|---|---|---|
| 419,490 | 1/1890 | Barratt | 472/33 |
| 865,584 | 9/1907 | Fulton et al. . | |
| 1,563,122 | 11/1925 | Uzzell . | |
| 1,712,340 | 5/1929 | Frankhauser et al. . | |
| 1,854,473 | 4/1932 | Laborda . | |
| 2,142,169 | 1/1939 | Bisch | 472/33 |
| 2,211,876 | 8/1940 | Barnard | 272/7 |
| 2,374,627 | 4/1945 | Strong | 244/142 |
| 2,525,458 | 10/1950 | Peterson | 272/29 |
| 2,848,231 | 8/1958 | Propst | 272/42 |
| 3,176,983 | 4/1965 | Barber | 272/29 |
| 3,456,943 | 7/1969 | Brown | 272/29 |
| 3,596,905 | 8/1971 | Brown | 272/29 |
| 3,612,517 | 10/1971 | Schwarzkopf | 272/29 |
| 3,633,904 | 1/1972 | Kojima | 272/7 |
| 3,787,046 | 1/1974 | Clem | 272/29 |
| 3,840,225 | 10/1974 | Fouché | 272/29 |
| 3,863,407 | 2/1975 | Eucken | 52/115 |
| 3,874,136 | 4/1975 | Michel | 52/115 |
| 3,885,503 | 5/1975 | Barber | 104/76 |
| 3,904,194 | 9/1975 | Schwarzkopf | 272/49 |
| 3,905,596 | 9/1975 | Barber | 272/29 |
| 4,007,926 | 2/1977 | Ottaway | 272/37 |
| 4,152,933 | 5/1979 | Woodhouse | 73/189 |
| 4,917,374 | 4/1990 | Petz | 272/29 |
| 5,046,719 | 9/1991 | Comstock et al. | 272/6 |
| 5,209,361 | 5/1993 | Grubb, Jr. | 212/158 |
| 5,564,983 | 10/1996 | Larson | 472/3 |
| 5,628,690 | 5/1997 | Spieldiener et al. | 472/131 |

OTHER PUBLICATIONS

Four (4) photographs of Hy–Ball device, 1959.

*Primary Examiner*—Kien T. Nguyen
*Attorney, Agent, or Firm*—Sidley & Austin

[57] ABSTRACT

A tower (150, 200, 250) is disclosed which can be used for an amusement ride, having gondolas (20) or for advertising, having an advertising sign (252). The tower has a lower section (16) and an upper section (18) and a lifter, such as a hydraulic cylinder, to lift the upper section (18) between a retracted position and an extended position. At least one cable interconnects the gondola or advertising sign and the lower section so that the gondola or advertising sign is lifted at twice the rate as the upper section. The tower can be mounted on a rotatable base (152) which rotates the entire tower about a vertical axis. Also, counterweights (202) can be used to reduce the load necessary on the lifter to lift the upper section.

8 Claims, 14 Drawing Sheets

TOWER

CROSS REFERENCE TO RELATED APPLICATIONS

This is a continuation in part of co-pending patent application Ser. No. 08/726,839 filed Oct. 8, 1996.

TECHNICAL FIELD OF THE INVENTION

This invention relates to a tower which can be elevated from a retracted position to an elevated position and used as an amusement ride or advertising display.

BACKGROUND OF THE INVENTION

Amusement rides are popular among both young and old. An example of one amusement ride is disclosed in U.S. Pat. No. 5,046,719 to Comstock et al. Because of the cost and difficulty of maintaining an amusement park, a large industry has developed in temporary amusement sites which can be readily set up on a fairground, shopping mall parking lot or a community park. These activities put a premium on the quick and efficient installation and erection of the amusement rides and other facilities.

A need always exists for improved amusement rides which are more fun for users and more efficient and quickly set up by the operators. In addition to the quality of the ride, it is important that the appearance of the device be attractive to visitors, both during the installation and erection of the device and during use.

Also, it is common to use tall signs to advertise. It is often difficult to erect these signs and to change the sign once erected. Therefore, a need exists for an improved system for providing advertising displays.

SUMMARY OF THE INVENTION

In accordance with one aspect of the present invention, an amusement ride is provided which has a lower section and an upper section. A device for lifting the upper section vertically relative to the lower section is provided which lifts the upper section between a retracted position and an extended position. A gondola is moveable along the upper section and at least one constant length flexible member is attached at one end to the gondola and to the other end to the lower section with the member passing over the upper end of the upper section. The lifting of the upper section to the extended position lifts the gondola through the flexible member at a rate twice as fast as the upper section is lifted. The lower section is mounted on a base which allows the entire ride to be rotated about a vertical axis.

In accordance with another aspect of the present invention, a tower is provided which has a lower section and an upper section. Lifting structure is provided for lifting the upper section vertically relative to the lower section. The upper section is lifted between a retracted position and an extended position. A device is movable along the upper section and at least one constant length flexible member is attached at one end to the device and at the other end to the lower section with the member passing over the upper end of the upper section. The lifting of the upper section to the extended position lifts the device through the flexible member at a rate twice as fast as the upper section is lifted. The device can be an advertising sign or gondolas for an amusement ride. In accordance with another aspect of the present invention, a counterweight is provided which exerts a force to lift the upper section to the extended position relative the lower section. This reduces the force from the lifting device necessary to move the upper section between the retracted position and extended position.

BRIEF DESCRIPTION OF THE DRAWINGS

For a more complete understanding of the present invention and for further advantages thereof, reference is now made to the following description of the preferred embodiment, taken in conjunction with the accompanying drawings, in which.

DETAILED DESCRIPTION

Figure 1:
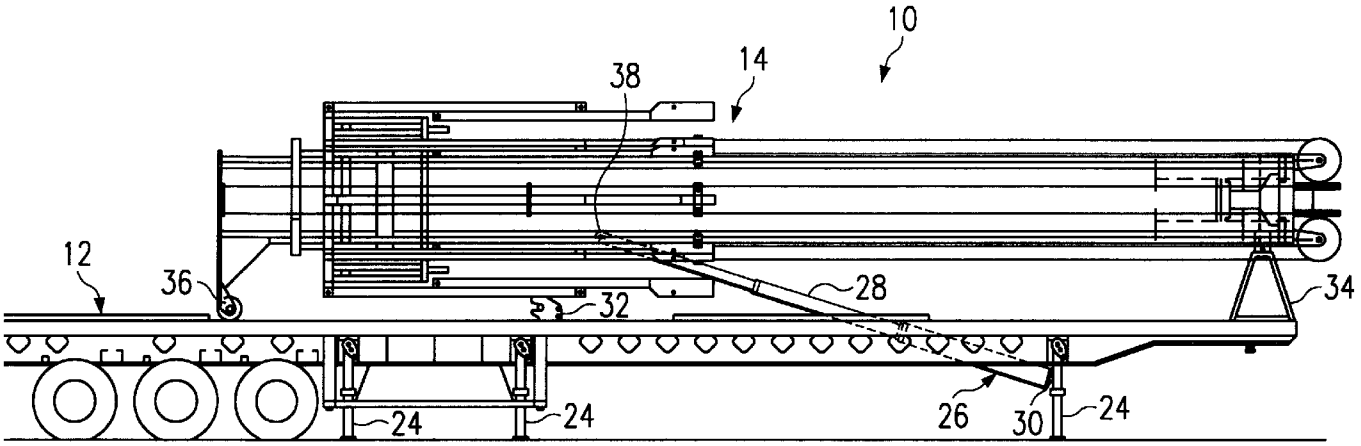
FIG. 1 is a side view of an amusement ride forming a first embodiment of the present invention shown in the transport position.
Figure 5:
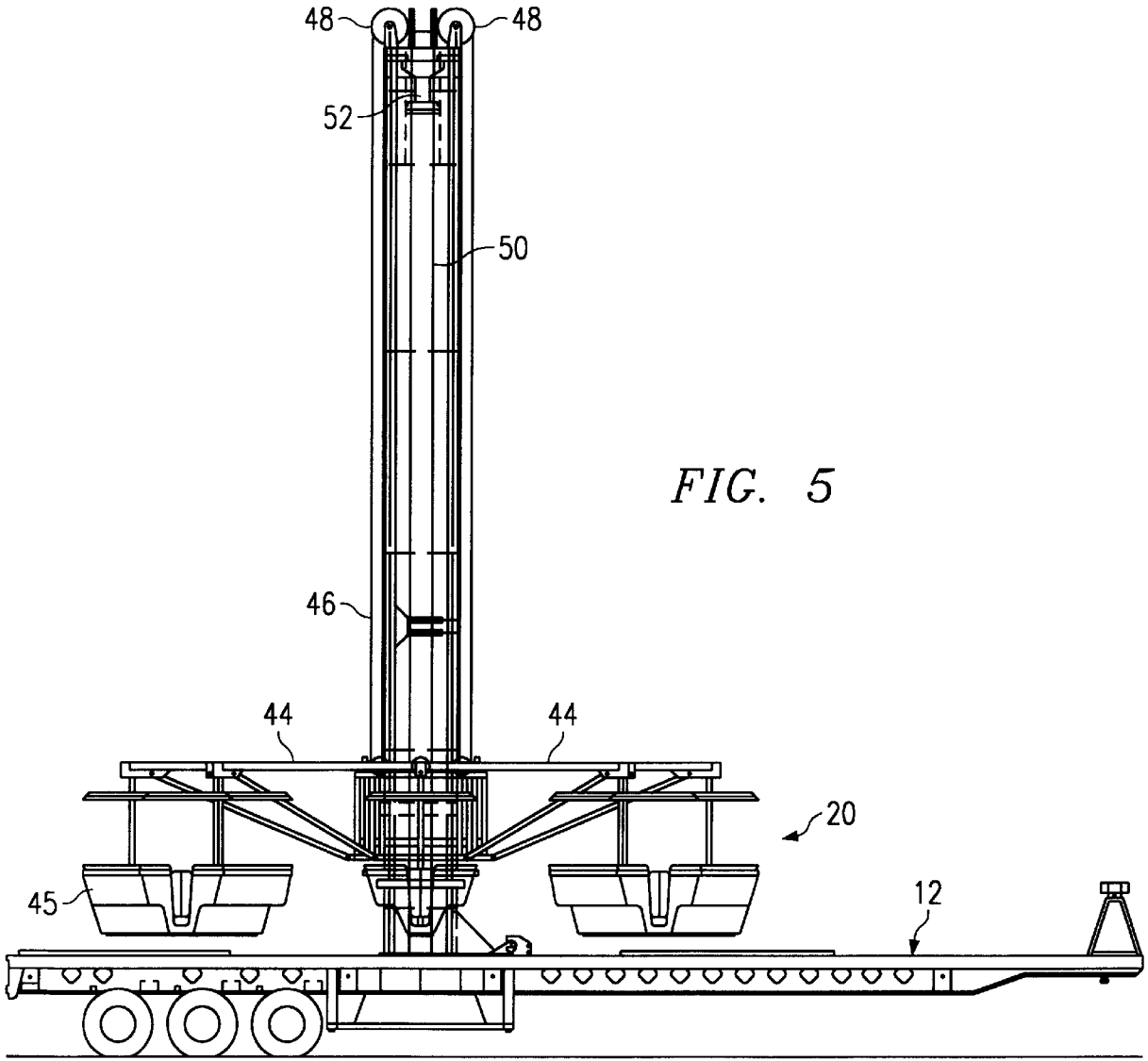
FIG. 5 is a side view of the amusement ride showing the gondola cars deployed.
Figure 6:
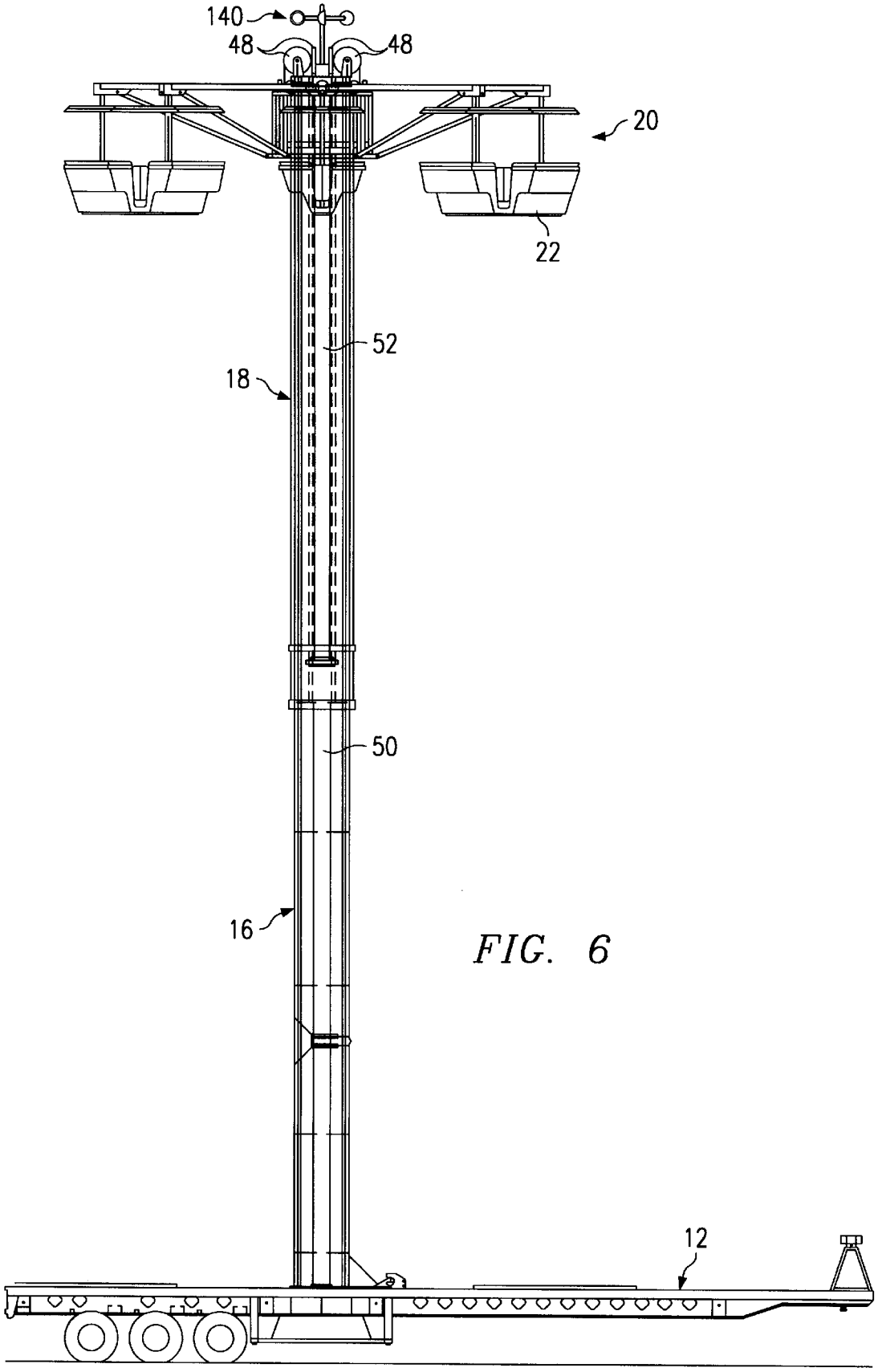
FIG. 6 is a side view of the amusement ride showing the upper tower section and the gondola in the operating position.

Referring to the figures, an amusement ride 10 forming a first embodiment of the present invention is illustrated. The amusement ride 10 includes a trailer 12 and a tower 14 which is movable from the transport position, as seen in FIG. 1 for transporting the amusement ride 10 along the highway, to the erected position, shown in FIGS. 5 and 6. The tower has a lower section 16, an upper section 18 and a gondola 20 supporting a number of gondola cars 22 for passengers. As best seen in FIGS. 5 and 6, the upper section 18 and gondola 20 can be moved between a lowered position, where the gondola is readily accessible for passengers to get on or off of the ride, to the elevated position, seen in FIG. 6, for the actual ride. As will be discussed in greater detail hereinafter, as the upper section 18 rises to the elevated position, the gondola 20 is drawn up at twice the rate of speed of the upper section 18 until the gondola is at the top end of the upper section. This provides both a thrilling ride for the passengers and an attraction to people passing by.

The trailer 12 is generally of conventional design suitable for carrying the ride along the highway. The trailer does have a series of deployable vertical supports 24 which contact the ground and act to stabilize the trailer when the tower is erected and the ride is in use. Further, the trailer mounts a double acting hydraulic cylinder 26 with piston 28. The cylinder 26 is pivoted to the trailer at pivot 30. The hydraulic cylinder 26 will be used to erect the tower as described hereinafter. Also, the trailer mounts a hinge support 32 and a cradle 34 near the front end of the trailer for supporting a portion of the tower 14 when in the transport position as seen in FIG. 1. In the transport position, the tower is positioned on the trailer for the optimal weight distribution for highway trailering.

Figure 2:
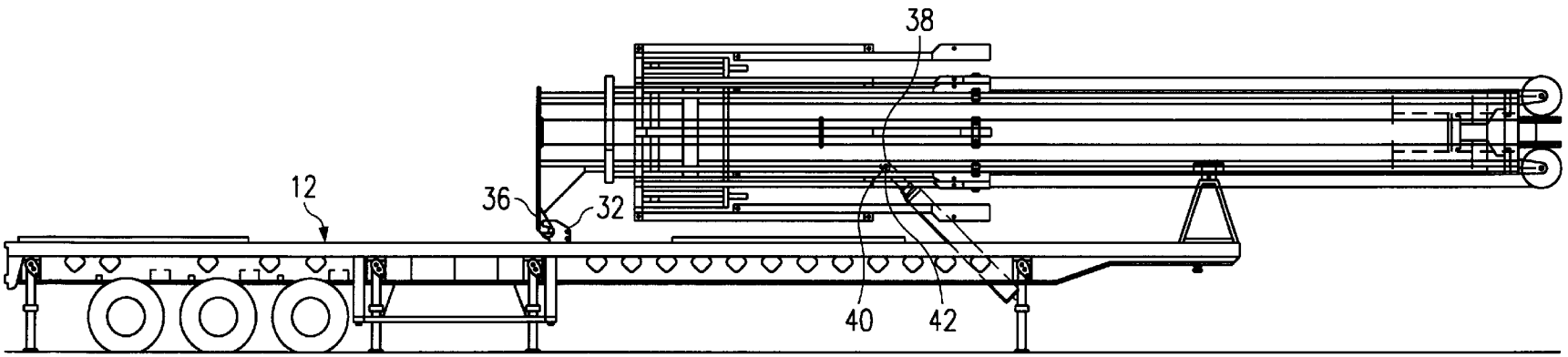
FIG. 2 is a side view of the amusement ride showing the tower moved to the forward position prior to erection.

With reference to FIGS. 1 and 2, when the amusement ride has reached the site where it is to be erected, the piston 28 is hooked to the tower near the middle of the tower. The apparatus, whether locks, straps, bands or other structure, used to secure the tower on the trailer for transport are removed so that the tower is free to move on the trailer. The hydraulic cylinder will then be activated to retract the piston into the cylinder, drawing the tower 14 forward on the trailer until the hinge 36 at the lower end of the lower section 14 engages the hinge support 32 on the trailer. At this point, the tower cannot be moved further forward on the trailer and the hinge is locked in place by the hinge support 32 so that the tower is confined to pivot about the hinge 36 as the tower is further erected.

Figure 3:
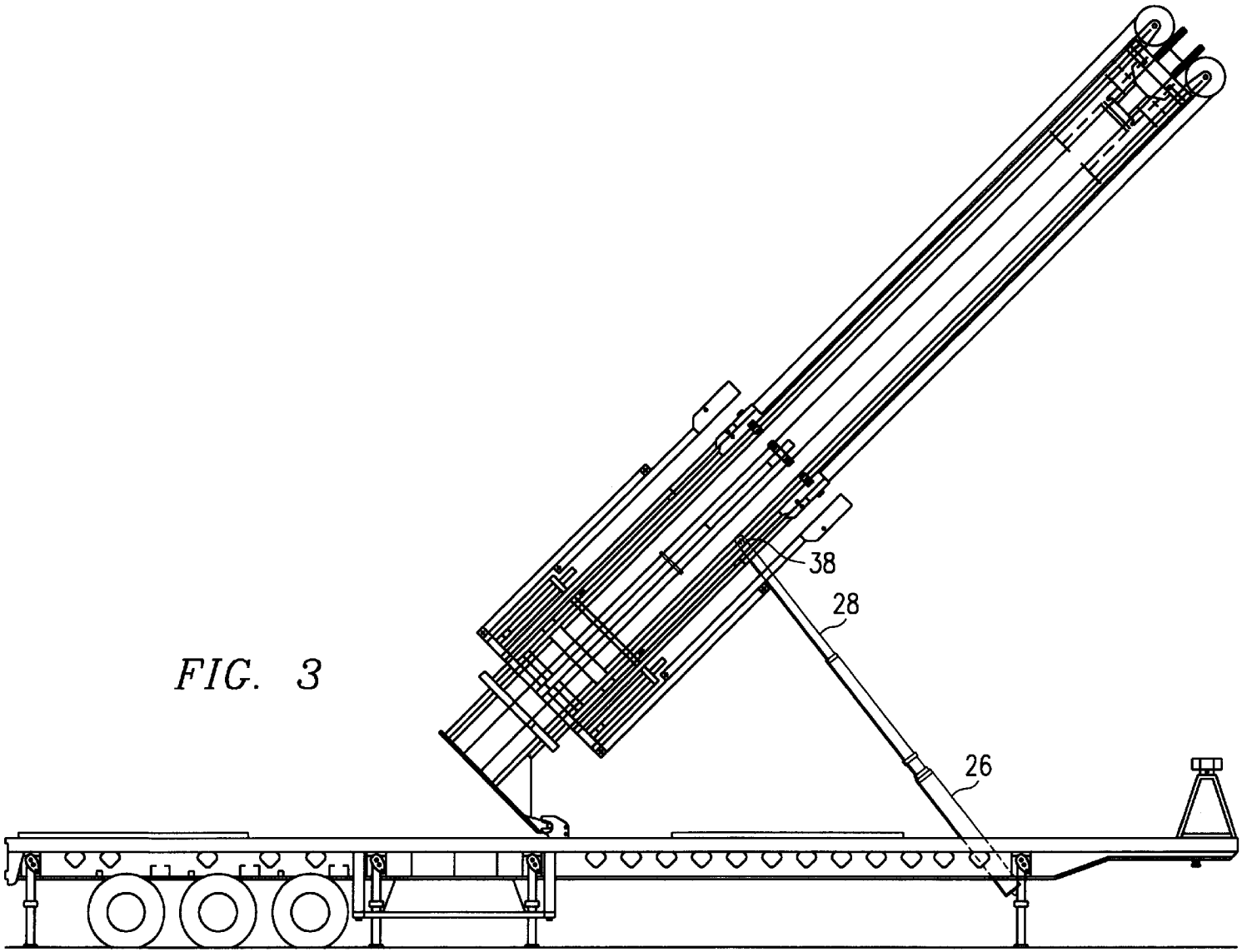
FIG. 3 is a side view showing the tower partially erected.
Figure 4:
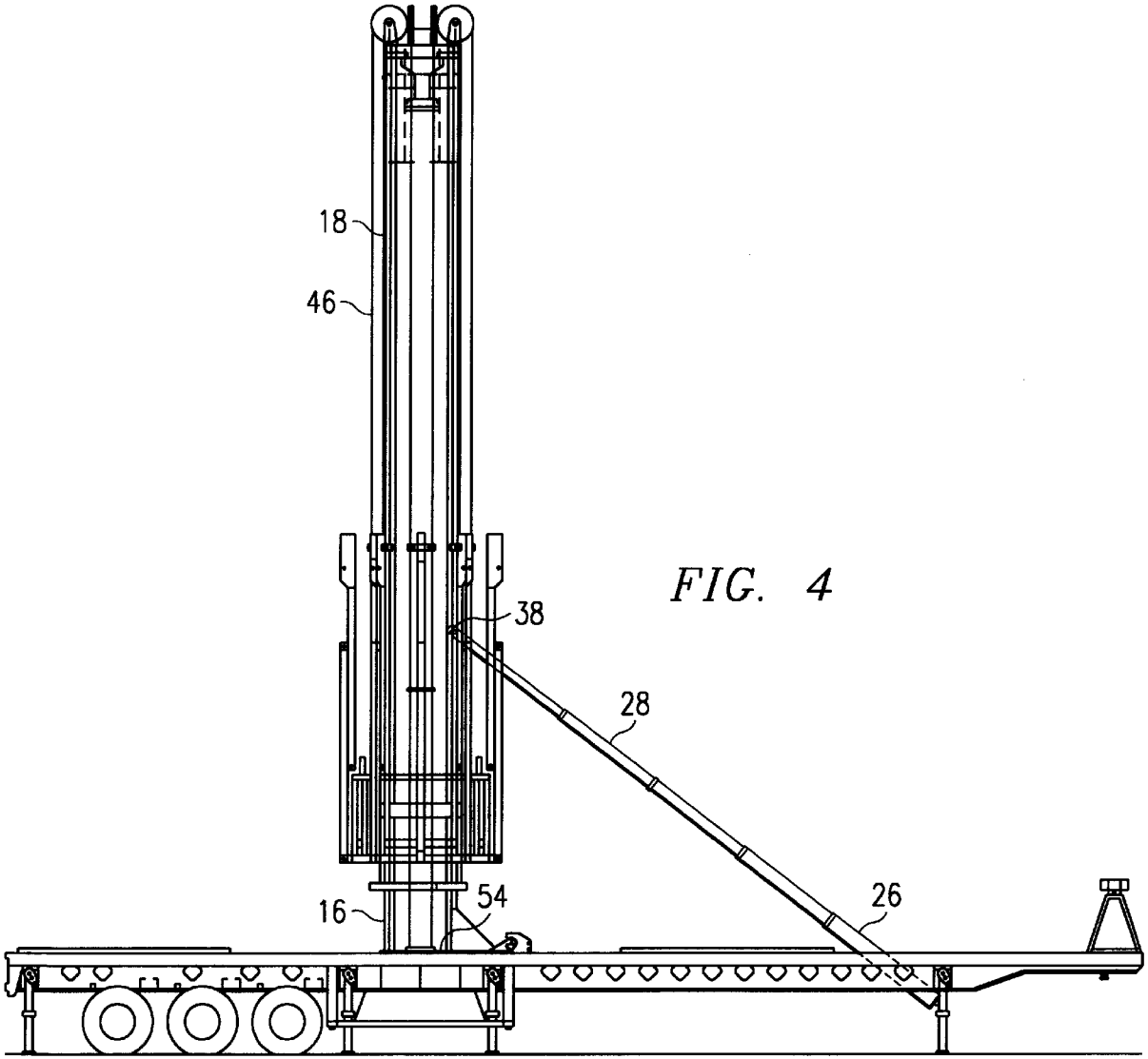
FIG. 4 is a side view of the amusement ride showing the tower in the vertical position.

As best seen in FIG. 3, the hydraulic cylinder 26 is then activated to extend the piston 28. Because the hinge 36 is fixed to the hinge support 32, this motion will cause the tower to pivot vertically until it reaches the vertical, erect position as seen in FIG. 4.

Figure 8:
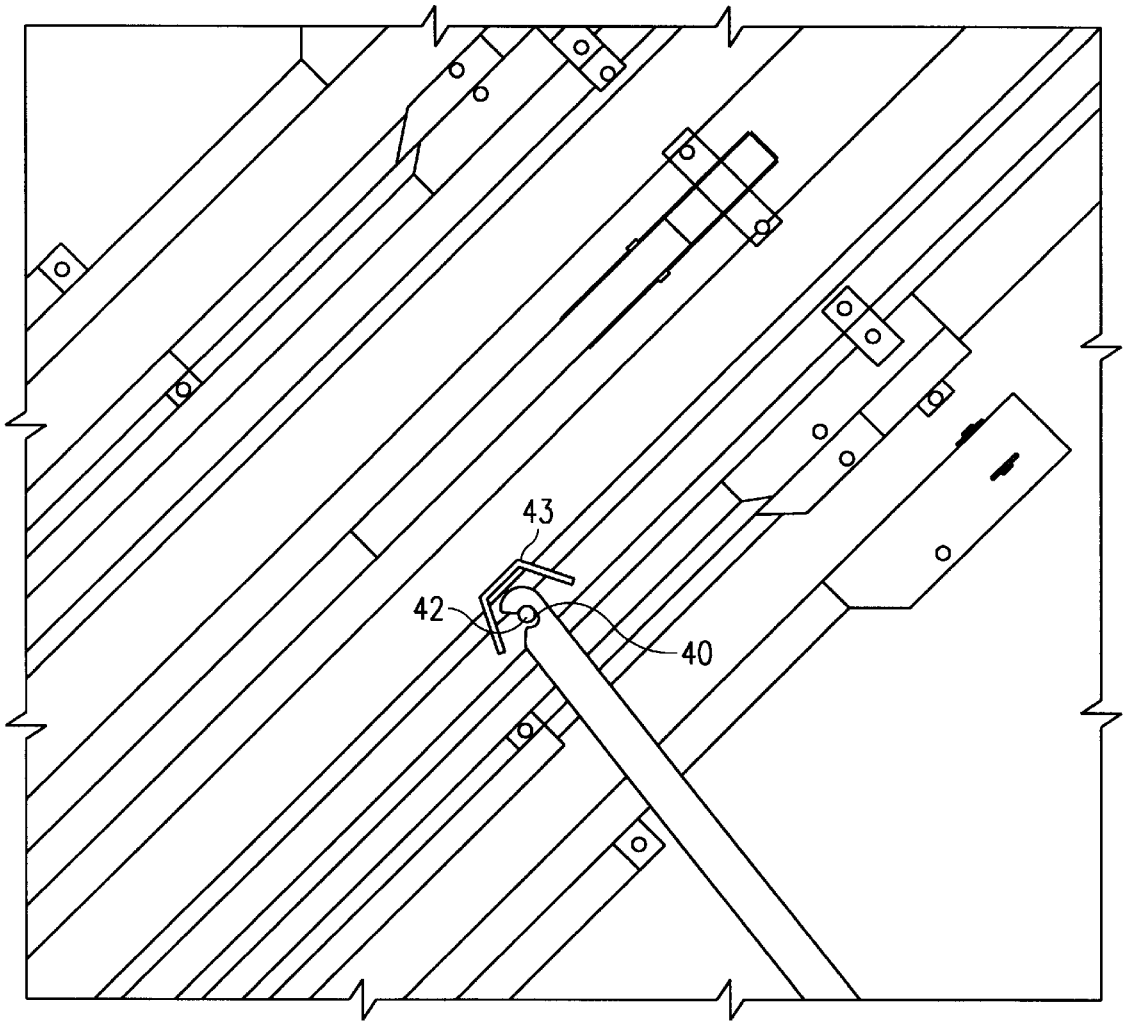
FIG. 8 is a detail view of the hook configuration mounted on the double acting hydraulic cylinder.

Once the tower is erected, the piston 28 will be removed from the lower section 16 and retracted for storage within the trailer until the tower is to be lowered. As seen in FIGS. 1–4, the end 38 of the piston 28 has a hook configuration with an opening 40 to allow the hook to be placed over a lifting pin 42 on the lower section 16. As can be seen, whether the piston is being extended or retracted, the hook can remain engaged with the lifting pin 42. Only when the piston is lifted vertically relative to the lifting pin so that the pin passes out through opening 40 can the piston be removed from a positive connection with the lower section 16. This design is shown in FIG. 8. If the free end of the piston was simply an eye which had to receive a pin inserted therein in a conventional manner, it would be very difficult to attach and detach the double acting cylinder from the tower. In the present invention, there is the large pin 42 permanently mounted in a cup 43 in the wall of the inner tower. The rod end of the double acting cylinder has the notch formed by opening 40, slightly larger than the pin, cut into an elongated slot. All that is required then to hook the cylinder is to extend it into the pocket above the fixed pin in the side of the inner tower. Gravity makes sure that it stays dropped over the pin and because of the notch effect at each end of the slot, whether the cylinder is under compression or tension, it is firmly secured to the tower.

Figure 7:
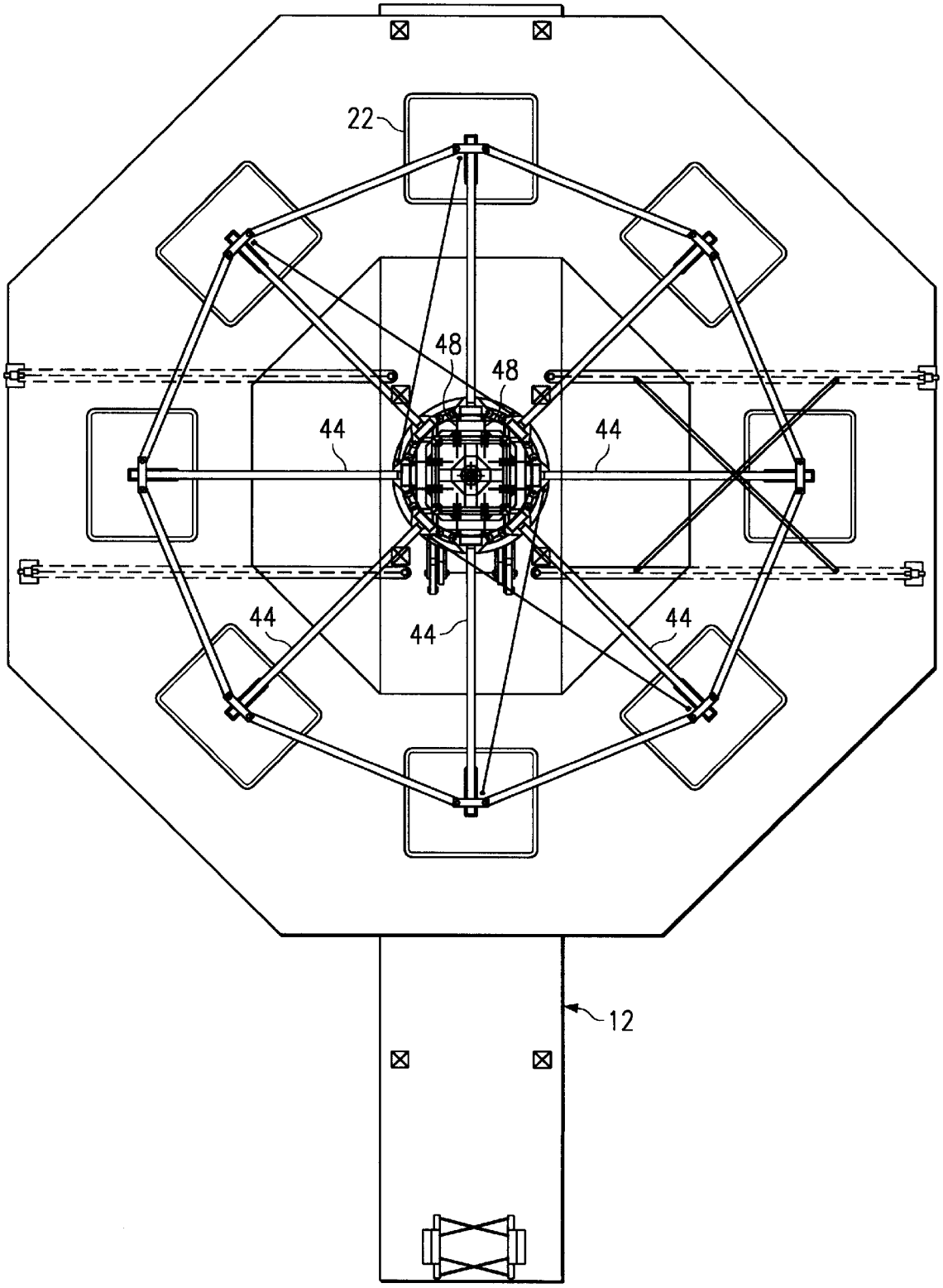
FIG. 7 is a plan view of the amusement ride.

With reference now to FIGS. 5 and 6, once the tower has been erected, the gondola 20, which is supported and guided on the upper section 18, will be deployed from the storage configuration to the operation configuration as seen in FIGS. 5–7. The gondola includes a series of gondola arms 44 which are pivotally attached to the upper section 18 and can pivot between the transport position and the operating position. When the gondola arms 44 are in the operating position, the gondola cars 45 will be mounted on the gondola arms 44. When the tower is in the transport position, the gondola cars 45 are stored on the trailer, usually in front of or behind the tower.

Figure 9:
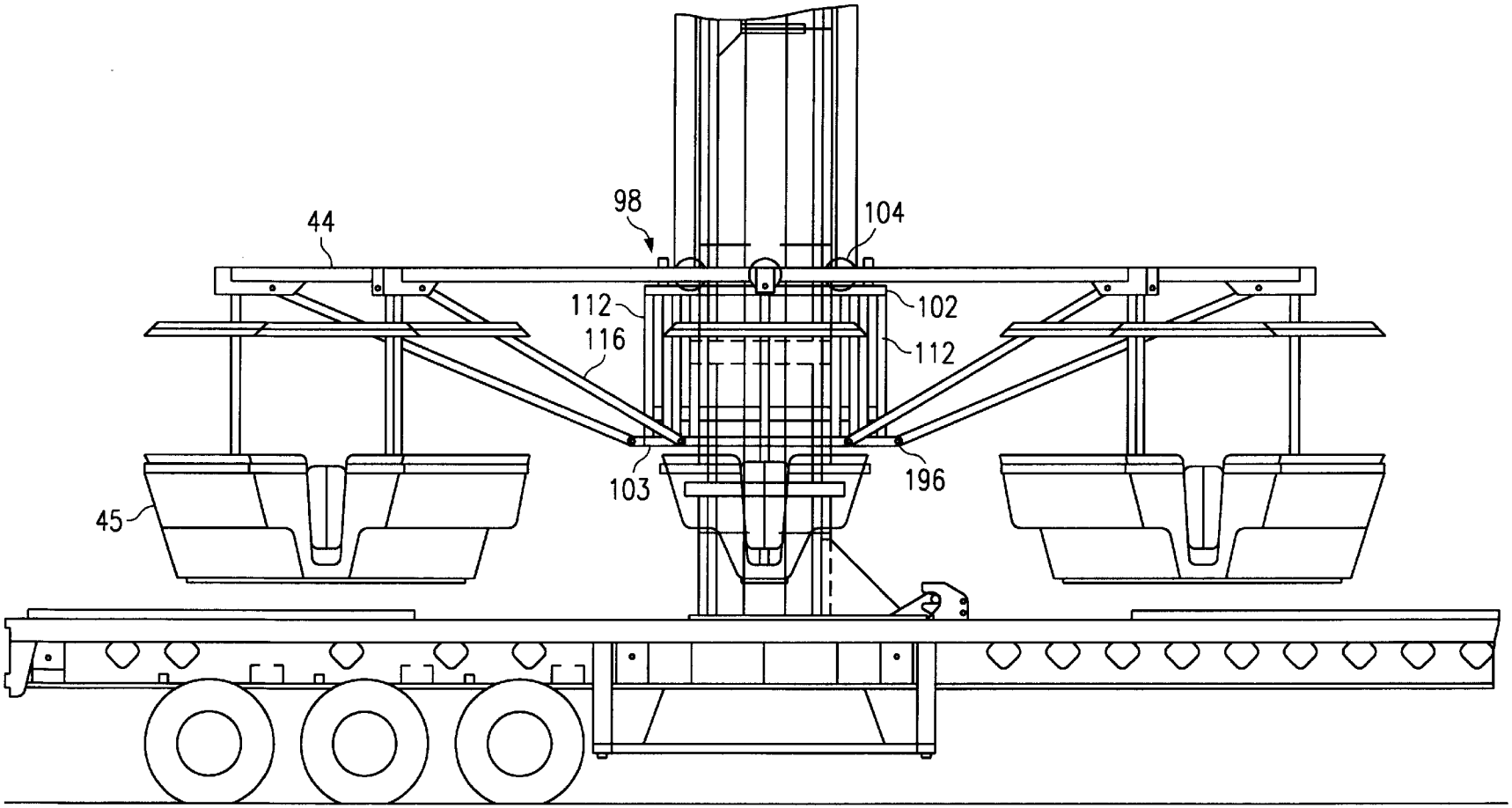
FIG. 9 is a side view of the gondola mechanism illustrating the rotation of the gondola cars relative the tower.
Figure 10:
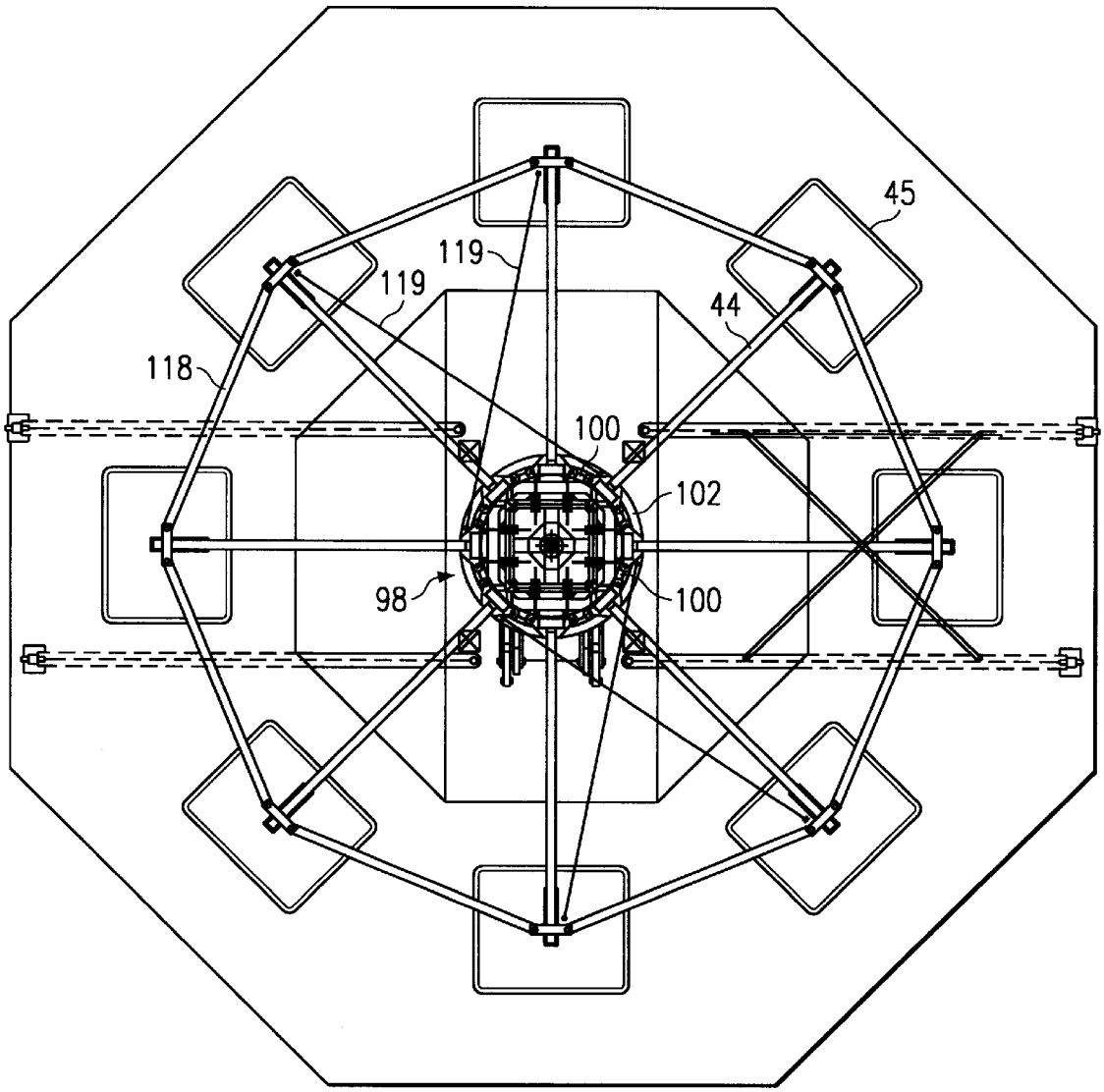
FIG. 10 is a plan view of the gondola arrangement.
Figure 11:
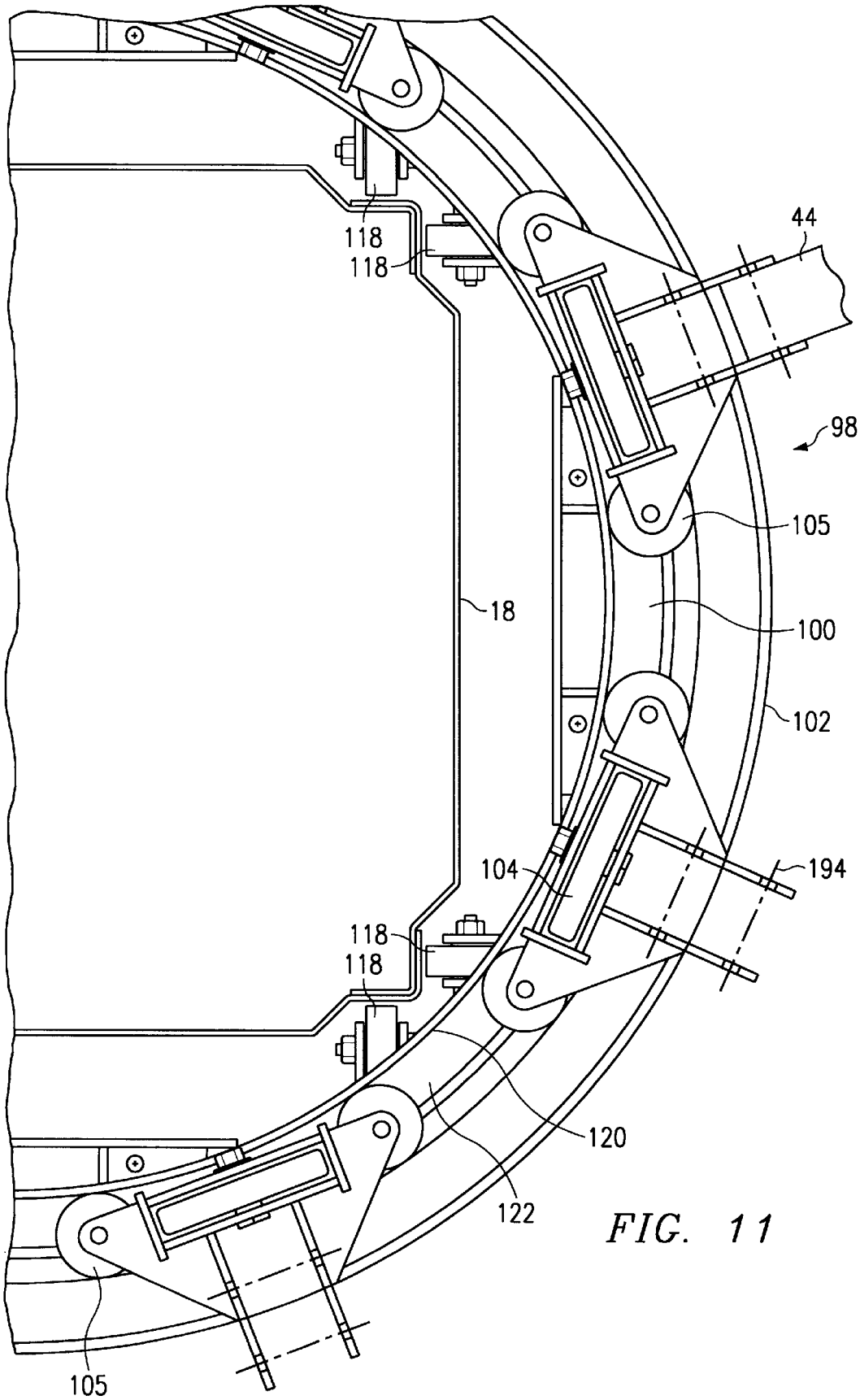
FIG. 11 is a partial plan view of the power ring structure.

With specific reference to FIGS. 9, 10 and 11, a power ring 98 is provided to support and rotate the gondolas. The power ring includes an inner upper ring 100 and inner lower ring 101 (not shown) interconnected by vertical bars 112 to form an inner cylindrical cage. The rings 100 and 101 and bars 112 connecting them do not rotate, but can move vertically relative to the upper section 18 through a series of guide wheels 118 mounted on the inner cage, bearing against the outer surface of the upper section as seen in FIG. 11. Preferably, eight guide wheels 118 are distributed about the inner cage near the inner upper ring 100 and eight guide wheels 118 are mounted on the inner cage near the inner lower ring 101 spaced vertically below the upper set of guide wheels. The inner upper ring 100 defines an outwardly facing annular vertical surface 120 and an upwardly facing horizontal arcuate surface 122. The inner lower ring 101 defines an outwardly facing vertical annular surface 124 (not shown).

The power ring 98 also includes a rotating cage assembly including an outer upper ring 102 and an outer lower ring 103 interconnected by vertical bars 112. Outer upper ring 102 is supported on the inner upper ring 100 through guide wheels 104 mounted on ring 102 which run along horizontal surface 122 which permit the outer ring 102 to rotate relative the inner ring 100 about the elongate axis of the tower. Guide wheels 105 are also mounted on the outer upper ring 102 which bear against the vertical annular surface 120 to maintain the axis of the rings 100 and 102 concentric as the gondolas rotate about the vertical axis of the tower. One or more electric motors are mounted on the inner ring 100 and rotate the outer cage at outer ring 102 through fluid couplings and friction members bearing against outer upper ring 102. The friction members are typically aluminum wheels with urethane tread mounted thereon which have a frictional engagement with the outer upper ring 102 assisted by a spring force. However, any other suitable drive mechanism could be used, such as a DC motor drive, a hydraulic drive or other suitable drive mechanism. The outer lower ring 103 mounts a series of guide wheels 126 (not shown) which bear against the inner lower ring 101 to assist in maintaining the outer cage concentric with the inner cage as it rotates.

The inner end of each arm 44 is pivotally secured at pivot 194 to outer upper ring 102 while the inner end of a brace arm 116 is pivotally secured at pivot 196 to the outer lower ring 103 directly beneath the arm 44. The opposite end of the brace arm 116 is secured near the outer end of the arm 44 to provide rigidity. The individual gondola cars 45 are suspended directly off of the end of the arms 44. Arms 118 also are mounted between the outer ends of adjacent arms 44 and wire cables 119 tensioned as shown for enhanced stability. To move the ride into the storage position, the outer end of the brace arms 116 are simply disconnected from the arms 44 and both arms 44 and brace arms 116 are pivoted relative the outer upper ring 102 and outer lower ring 103 to lie parallel the length of the tower, as seen in FIG. 1. Arms 118 and gondola cars 45 are removed prior to pivoting the arms 44 and 116 into the transport position.

Eight cables 46 are secured at one end thereof to inner ring 100 and at the other end to the lower section 16 near the base of the lower section. Between the ends, the eight cables 46 pass over dedicated cable pulleys 48 mounted at the upper end of the upper section 18. The pulleys are mounted symmetrically at the top of the upper section, as seen in FIG. 7, in pairs to effectively distribute the force loads exerted thereon.

A lifting cylinder 50 is mounted within the lower section 16 and secured at its lower end to the bottom of the lower section 16. The piston 52 of the cylinder is attached at its exterior end to the top of the upper section 18. As hydraulic fluid is supplied to the lifting cylinder 50, the piston 52 will move vertically out of the cylinder, causing the upper section 18 to rise vertically relative to the lower section 16 and trailer 14. Because of the geometry of the cable placement, the gondola will also rise, guided by the exterior surface of the upper section, but at a velocity twice the rate of the lifting of the upper section 18 and piston 52. When the piston 52 is fully extended as seen in FIG. 6, the gondola 20 is positioned at the upper end of the upper section 18.

The gondola cars 45 can be rotated about the vertical axis to enhance the experience of the passengers. The gondola cars can be rotated as they are lifted and lowered vertically by the cylinder 50 and when they are in the elevated position seen in FIG. 6. Alternatively, the gondola cars can be lifted without rotating and rotation initiated only when it is in the lifted position as seen in FIG. 6.

The upper section 18 is supported on the piston 52. The lower section 16 includes guides which assist the upper section 18 to smoothly move in the vertical direction, but the lower section does not otherwise support the upper section. Similarly, the cable pulleys 48 are mounted on the upper section immediately proximate the end of the piston 52. Thus, the large force carrying components of the upper section are in a compact configuration which allows for minimization of materials and cost. The portion of the upper section which extends downward acts as a guide for the power ring but otherwise is essentially decorative and serves only to hide the inner working components of the ride, such as the cylinder 50 and piston 52.

Preferably, load cells 54 are mounted at each anchor point of a cable 46 to the base of the lower section 16. This allows the operator to continuously monitor the force exerted by the cables and to take appropriate action if the forces become unbalanced. The load cells provide a very important feature from an operational and safety standpoint. The gondola cars are preferably rotated about the vertical axis by two one horsepower motors. The power for the motors is supplied through bus bars extending along the lower and upper sections 16 and 18.

When the ride is over, the piston 52 is lowered within cylinder 50 to lower the upper section 18 and the gondola 20. Again, the gondola will fall at a rate twice as fast as the upper section 18. By the time the piston 52 returns to its fully retracted position, the gondola 20 will have moved to its lowest position, where the passengers can be unloaded and new passengers embarked.

When the ride is to be transported to another site, the tower is lowered by the hydraulic cylinder 26 by simply reversing the process described above in erecting the tower. The hinge 36 is released from the hinge support 32 and the hydraulic cylinder 26 drives the tower rearward on the trailer 12 until the tower is in the transport position as seen in FIG. 1.

A weather station 140 is preferably mounted at the top of the upper section 18. The wind velocity will be measured by this station and the operator will be warned to lower the section 18 and gondola 20 should the winds become severe.

In one amusement ride constructed in accordance with the teachings of the present invention, travel of the piston 52 is about 40 feet. The gondola 20 will be lifted eighty feet as it moves from its lowest position to its highest position as the piston is extended. The piston 28 will extend sixteen feet.

In another embodiment, the upper section of the tower can be separate from the gondola and lifting cylinder. As such, the tower can be raised to the elevated position and locked in place. The hydraulic cylinder can then be activated to lift the gondola cars and operating mechanisms to the elevated position.

Figure 12:
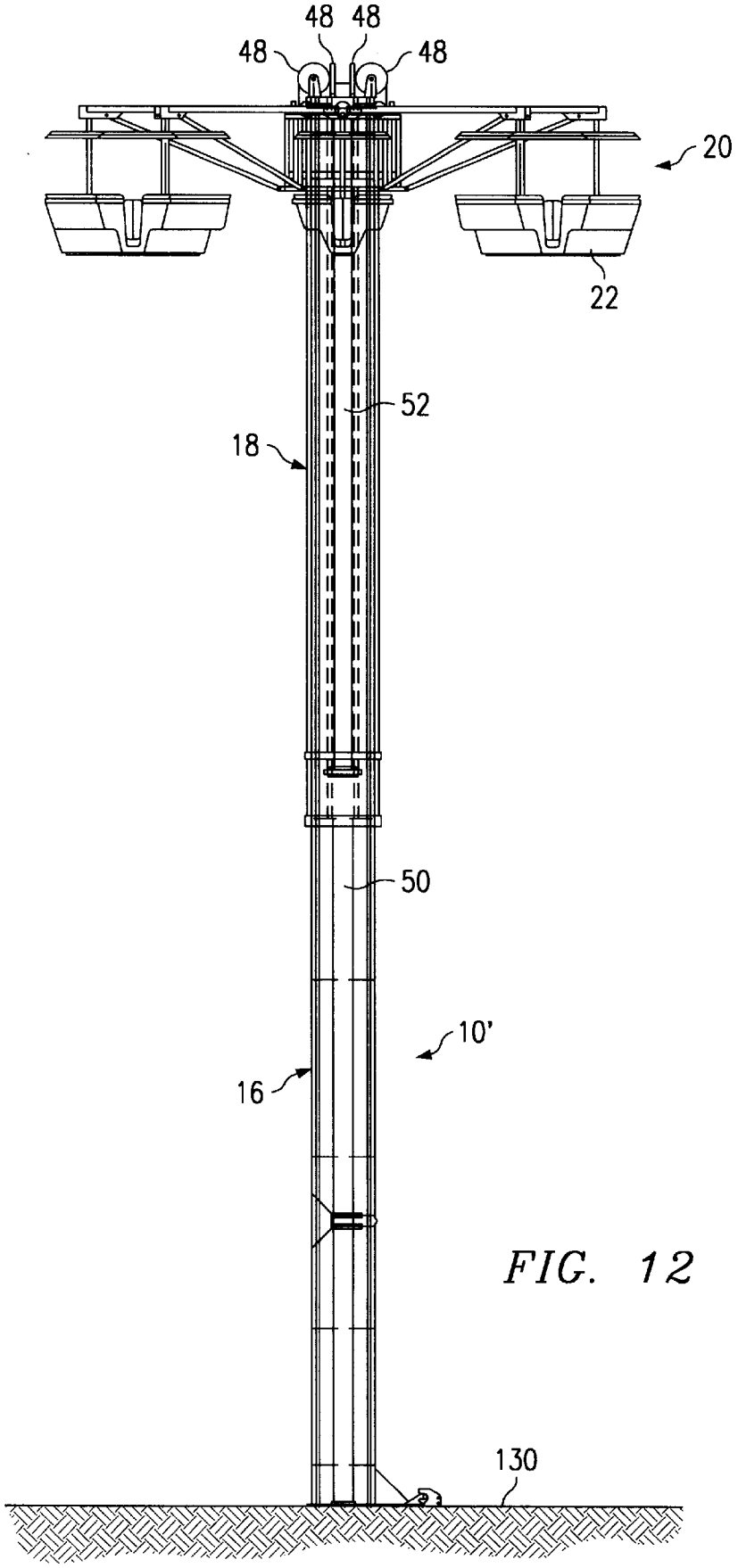
FIG. 12 is an illustrative view of another embodiment of the present invention showing the amusement ride permanently installed at a park or similar facility.

The amusement ride can also be a permanently installed ride at an amusement park or other facility as shown in FIG. 12 as ride 10'. As such, the tower would raise and lower just as discussed above. There would be no need to tilt the tower, however, except in installing the tower and when its service is complete. In the interim, the tower can be permanently mounted in the ground 130 in the vertical position by any acceptable structure, such as a concrete base, metal base, etc., for use.

Figure 13:
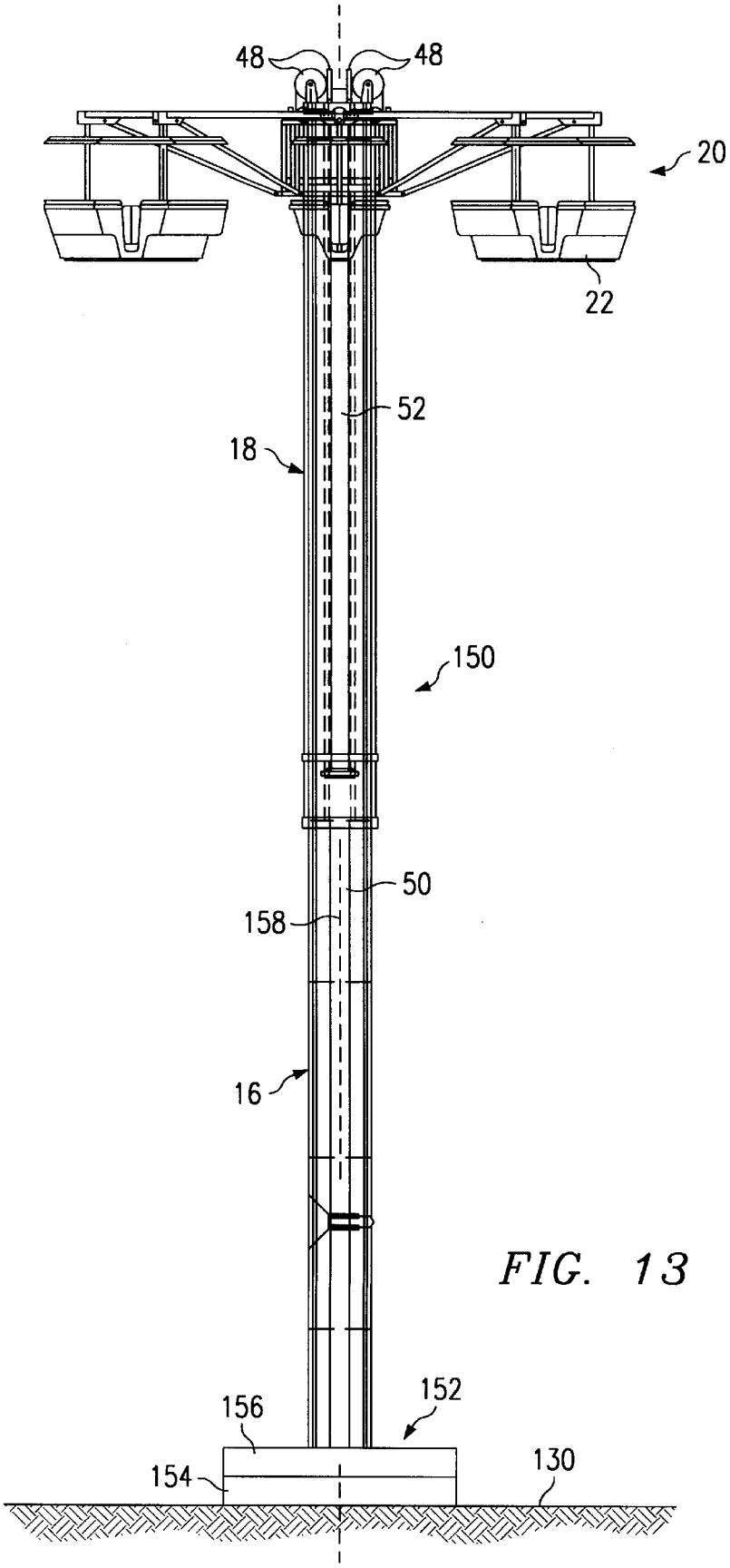
FIG. 13 is an illustrative view of another embodiment of the present invention showing the amusement ride mounted for rotation about a vertical axis.

With reference now to FIG. 13, a modified tower 150 is illustrated. Tower 150, in most regards, is identical to tower 10'. However, tower 150 is mounted on a base 152 which has a stationary portion 154 and a rotary portion 156 which is capable of rotating itself and the tower 150 about vertical axis 158. In this embodiment, as the entire tower 150 is rotated, there is no need for a separate rotation mechanism for the gondolas 20 relative to the upper section 18, unless an additional effect is desired, such as accelerated rotation or a decrease in the rotation of the gondolas. For example, the gondolas could be rotated in the opposite direction of the tower at the same speed to effectively provide cessation of rotation of the gondolas about a vertical axis, while the tower is still rotated to provide an additional effect.

Figure 15:
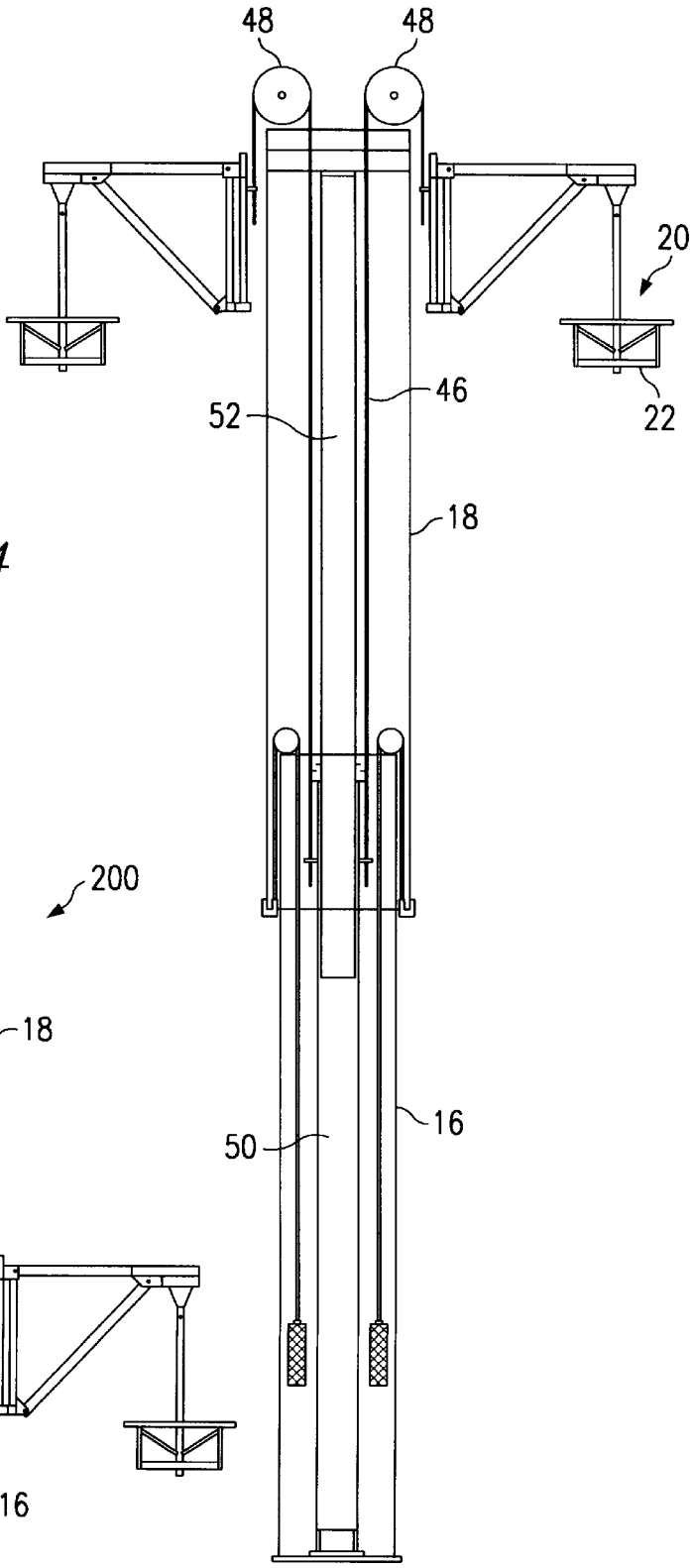
FIG. 15 is a vertical cross-sectional view of the amusement ride of FIG. 14 in the elevated position.
Figure 14:
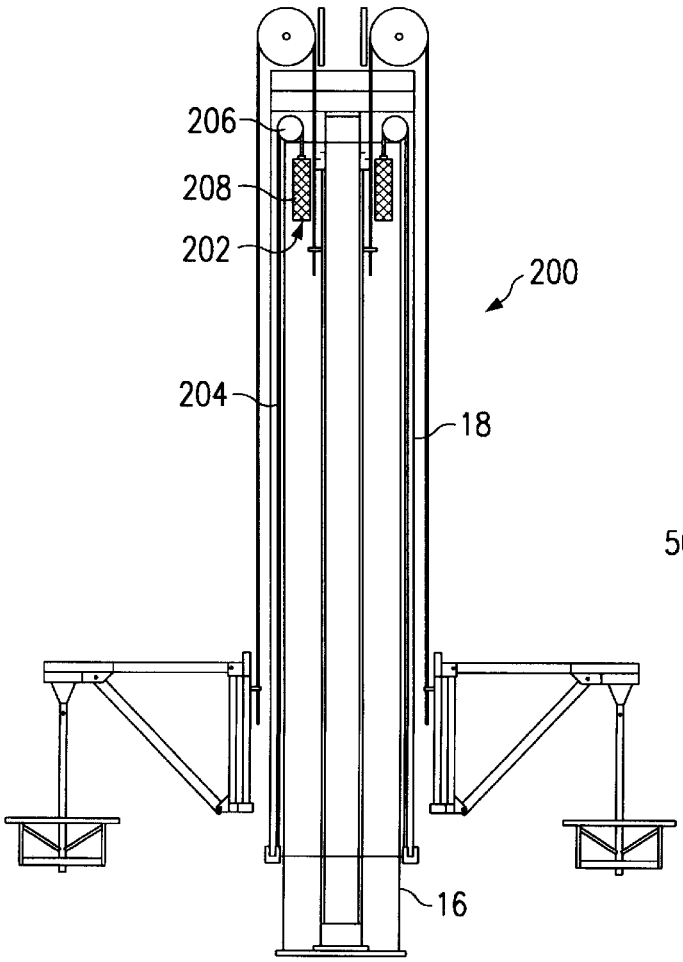
FIG. 14 is a vertical cross-sectional view of another embodiment of the present invention showing an amusement ride partly counterbalanced by counterweights in a lowered position.

With reference to FIGS. 14 and 15, a tower 200 forming a modification of tower 10' is illustrated. In this embodiment, many elements of tower 200 are identical with those of tower 10' and 10 and are identified by the same reference numerals.

Tower 200 includes a set of counterweights 202 which reduce the load placed on the lifting cylinder 50 to lift the upper section 18 relative the lower section 16. More specifically, each counterweight 202 includes a cable 204 secured at one end to the lower end of the upper section 18. The cable 204 passes over a pulley 206 which is mounted at the upper end of the lower section 16. A weight 208 is mounted at the opposite end of the cable 204 which extends within the confines of the lower section 16. Any number of counterweights 202 can be provided. Preferably, the counterweights are distributed to provide a balanced lifting force directed along the center vertical axis of the tower. The weight of the counterweights 202 tends to counteract the weight of the upper section 18, reducing the load necessary to lift the upper section 18 from the lowered position, as seen in FIG. 14, to the elevated position, as seen in FIG. 15. Thus, a lifting cylinder 50 of smaller capacity can be used, or the load carried by the upper section 18 can be increased for a given design.

Figure 17:
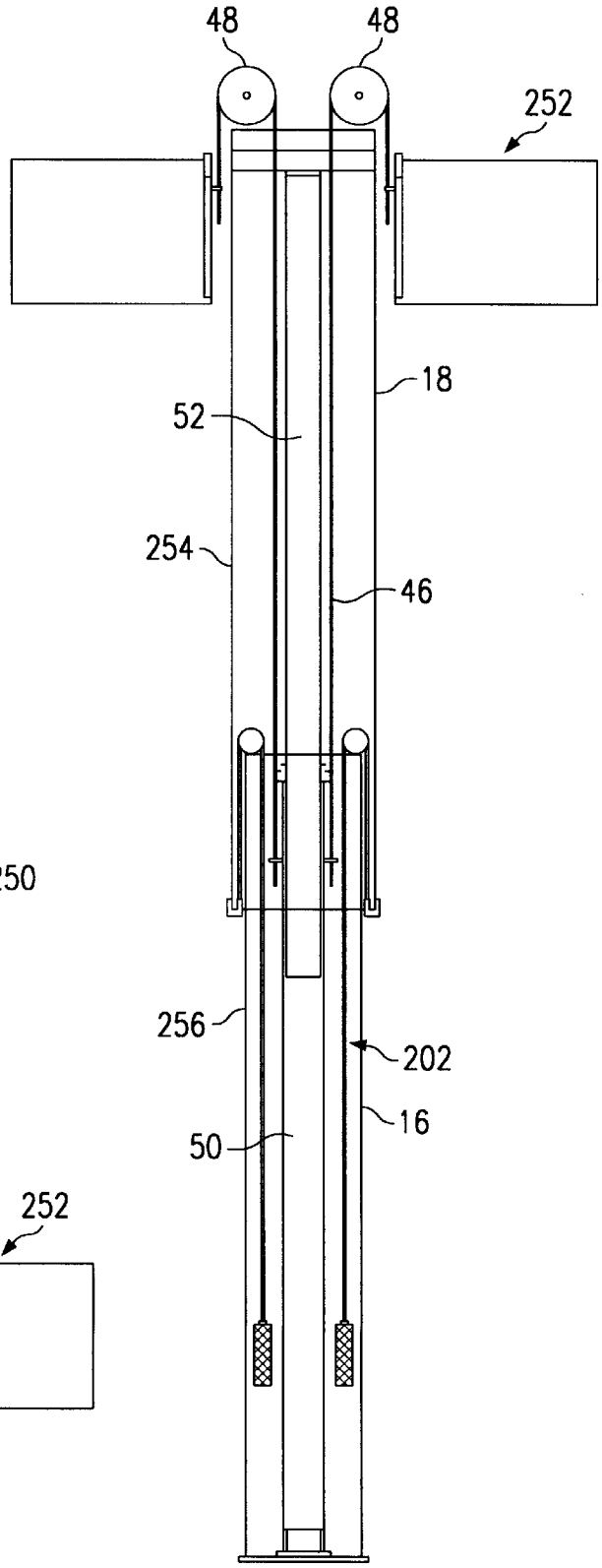
FIG. 17 is a vertical cross-sectional view of the tower of FIG. 16 in the elevated position.
Figure 16:
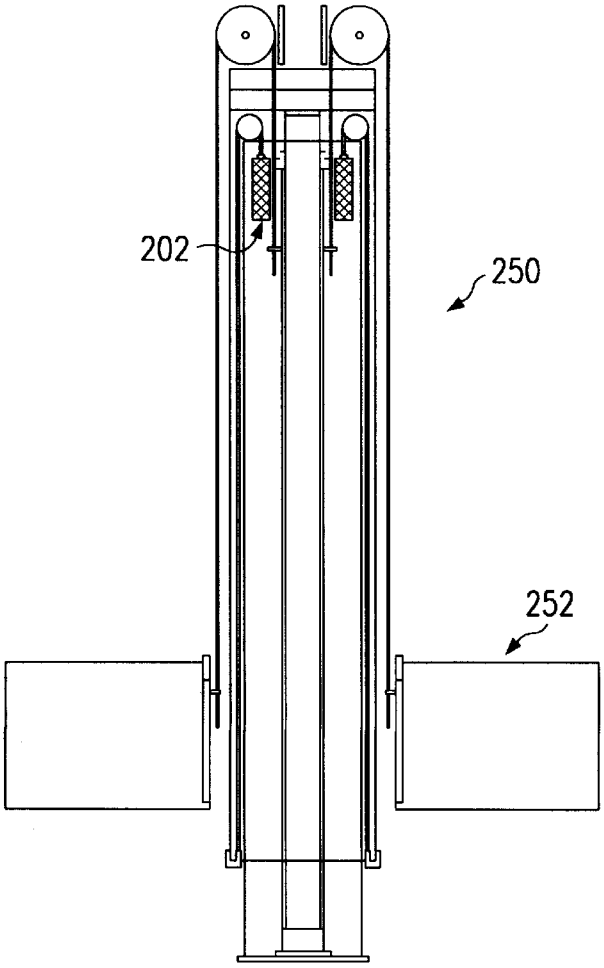
FIG. 16 is a vertical cross-sectional view of another embodiment of the present invention illustrating a commercial sign tower in the lowered position.

With reference to FIGS. 16 and 17, a tower 250 is disclosed which can be used for advertising purposes. Many aspects of the tower 250 are identical to tower 10', 150 and 200 described previously, however, tower 250 will not be supplied with the gondola 20. Instead, an advertising sign 252 will be mounted in place of the gondola 20 which will rise at twice the rate of the upper section 18 as the tower 250 moves from the retraced position, seen in FIG. 16, to the elevated position, seen in FIG. 17. The sign 252 can be rotated about a vertical axis relative upper section 18 with the same mechanism as gondola 20 on tower 10, or can be fixed relative upper section 18. As illustrated, the tower 250 incorporates counterweights 202. This permits a heavier sign 252 to be lifted than would otherwise be possible with the force provided by the lifting cylinder 50. If desired, the upper section 18 can also have advertising 254 thereon as well. If desired, the lower section 16 can have advertising 254 thereon as well. If desired, the lower section 16 can have advertising 256, which, for example, may only appear as the tower moves to the elevated position. The tower 250 can be mounted on a base 152 for rotation about its vertical axis.

Although the present invention has been described with respect to specific preferred embodiments thereof, various changes and modifications may be suggested to one skilled in the art, and it is intended that the present invention encompass such changes and modifications as fall within the scope of the appended claims.

I claim:

1. An apparatus, comprising:

a base, said base having a stationary portion and a rotating portion;

a lower section mounted to the rotating portion of the base;

an upper section having an upper end;

a lifter for lifting the upper section vertically relative to the lower section between a retracted position and an extended position;

a device mounted on the upper section for motion relative thereto;

at least one constant length flexible member attached at one end to the device and at the other end to the lower section, the member passing over the upper end of the upper section, the lifting of the upper section lifting the device through the flexible member at a rate twice as fast as the upper section is lifted; and rotation of the rotating portion of the base relative the stationary portion further rotating the lower section, upper section and device.

2. The apparatus of claim 1 wherein the device is a gondola.

3. The apparatus of claim 1 wherein the device is an advertising sign.

4. The apparatus of claim 1 further comprising a counterweight mounted between the lower section and the upper section acting to exert a force to lift the upper section to the extended position.

5. An apparatus, comprising:

a lower section;

an upper section having an upper end;

a lifter for lifting the upper section vertically relative to the lower section between a retracted position and an extended position;

a device mounted on the upper section;

at least one constant length flexible member attached at one end to the device and at the other end to the lower section, the member passing over the upper end of the upper section, the lifting of the upper section lifting the device through the flexible member at a rate twice as fast as the upper section is lifted;

a counterweight mounted to the lower section acting to exert a force on the lower section to lift the upper section to the extended position.

6. The apparatus of claim 5 further including a plurality of counterweights.

7. The apparatus of claim 5 wherein the device is an advertising sign.

8. The apparatus of claim 5 wherein the device is a gondola for an amusement ride.

* * * * *